US011291289B2

(12) United States Patent
Elias

(10) Patent No.: US 11,291,289 B2
(45) Date of Patent: Apr. 5, 2022

(54) KEY ASSIST DEVICES

(71) Applicant: Key-Ker Clip Ltd., Tel Aviv (IL)

(72) Inventor: Amir Elias, Ramat Hasharon (IL)

(73) Assignee: Key-Ker Clip Ltd., Tel Aviv (IL)

( * ) Notice: Subject to any disclaimer, the term of this patent is extended or adjusted under 35 U.S.C. 154(b) by 429 days.

(21) Appl. No.: 16/481,706

(22) PCT Filed: Feb. 4, 2018

(86) PCT No.: PCT/IL2018/050123
§ 371 (c)(1),
(2) Date: Jul. 29, 2019

(87) PCT Pub. No.: WO2018/142410
PCT Pub. Date: Aug. 9, 2018

(65) Prior Publication Data

US 2019/0380480 A1 Dec. 19, 2019

(30) Foreign Application Priority Data

Feb. 5, 2017 (IL) ..... 250458

(51) Int. Cl.
*A45F 5/02* (2006.01)
*A47G 29/10* (2006.01)

(52) U.S. Cl.
CPC ..... *A45F 5/02* (2013.01); *A47G 29/10* (2013.01); *A45F 2200/0558* (2013.01)

(58) Field of Classification Search
CPC ... A45F 5/02; A45F 2200/0558; A47G 29/10; A45C 11/32; A45C 11/321; A45C 2001/026
See application file for complete search history.

(56) References Cited

U.S. PATENT DOCUMENTS

| | | | | |
|---|---|---|---|---|
| 1,473,361 A | | 11/1923 | Tebbetts | |
| 1,525,849 A | | 2/1925 | Buxton | |
| 2,468,959 A | | 5/1949 | Cannon | |
| 3,092,244 A | | 6/1963 | McWhirter | |
| 3,955,725 A | | 5/1976 | Rese | |
| 5,113,602 A | * | 5/1992 | Levine | G09F 3/08 40/330 |

(Continued)

FOREIGN PATENT DOCUMENTS

| | | | |
|---|---|---|---|
| DE | 2061413 | A1 | 6/1972 |
| DE | 10-2004-027182 | A1 | 12/2005 |
| JP | 5443634 | A | 3/2014 |

OTHER PUBLICATIONS

Supplementary European Search Report for EP18748186, search completed on Jul. 10, 2020.

*Primary Examiner* — Robert Sandy
*Assistant Examiner* — Rowland Do

(57) ABSTRACT

Key assist devices for enabling a user to conveniently and repeatedly attach a key to a key ring's split ring and detach it therefrom and, during its detachment, securely clamp the key to a clothing item for safely carrying the key. The key assist devices include a spring clip with the interchangeability functionality of freely and directly suspending a key from a key ring's split ring and clamping the key on a clothing item. The key assist devices are designed such that they are unable to merely slide off a split ring but rather requires a specific user manipulation.

10 Claims, 19 Drawing Sheets

(56) References Cited

U.S. PATENT DOCUMENTS

| | | | | |
|---|---|---|---|---|
| 5,181,927 | A * | 1/1993 | Song | E05B 17/103<br>362/116 |
| 5,365,760 | A | 11/1994 | Song | |
| 5,768,924 | A | 6/1998 | Song | |
| D575,054 | S | 8/2008 | Walcott | |
| 2011/0302970 | A1* | 12/2011 | Amron | E05B 19/04<br>70/456 R |
| 2015/0059937 | A1 | 3/2015 | Singer | |

* cited by examiner

KEY ASSIST DEVICES

FIELD OF THE INVENTION

This invention relates to key clips, key housings, and the like.

BACKGROUND OF THE INVENTION

People tend to attach their everyday keys, for example, a house key, an ignition key, an office key, and the like, to a key ring. Key rings include a split ring enabling a person to attach a key thereonto and remove it therefrom. Such attachment and detachment requires considerable dexterity and is time wasting. Key rings are unwieldy during a wide range of human activities such that many people tend to tiresomely detach, say, a house key, from a key ring before an activity and hold it or carry it on their person before re-attaching it to the key ring after the activity. Holding or carrying a key during an activity is also problematic and can often lead to its loss.

Key clips, key housings, and the like, for assisting in everyday handling of keys are disclosed in inter alia U.S. Pat. No. 1,473,361 to Tebbett's U.S. Pat. No. 1,525,849 to Buxton, U.S. Pat. No. 2,468,959 to Cannon, U.S. Pat. No. 3,092,244 to McWhirter, U.S. Pat. No. 5,365,760 to Song, U.S. Pat. No. 5,768,924 to Song, U.S. Design Pat. No. 575,054 to Walcott, US 2015/0059937 to Singer, DE 2061413 and JP 5443634.

SUMMARY OF THE INVENTION

The present invention is directed towards key assist devices for enabling a user to conveniently interchangeably attach a key to a key ring's split ring and detach it therefrom and, during its detachment, securely clip the key onto a clothing item's hem, a shoe, and the like, for safely carrying the key, and detach it therefrom. The key assist devices include a spring clip designed such that a key can be freely and suspended from a key ring's split ring as if it was directly and freely suspended therefrom. The key assist devices are designed such that a key assist device is unable to merely slide off a split ring but rather requires a specific user manipulation to prevent inadvertent detachment. The specific user manipulation can be readily learnt and considerably requires less time and dexterity than for present attachment of a key to a split ring and detachment therefrom. The key assist devices are also designed to prevent a key from repeatedly lightly hitting a user's body during a sport activity, for example, running.

Key assist devices of the present invention can be implemented as follows: First, a discrete keyhead housing for entrapping a discrete key's keyhead. Second, a discrete keyhead connector for connecting to a discrete key's keyhead. The first and second implementations are intended to be manufactured and marketed as aftermarket products. And third, a clip-on key in which a key assist device is manifested as a key's keyhead.

BRIEF DESCRIPTION OF THE DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF THE DRAWINGS

Overview

Figure 1A:
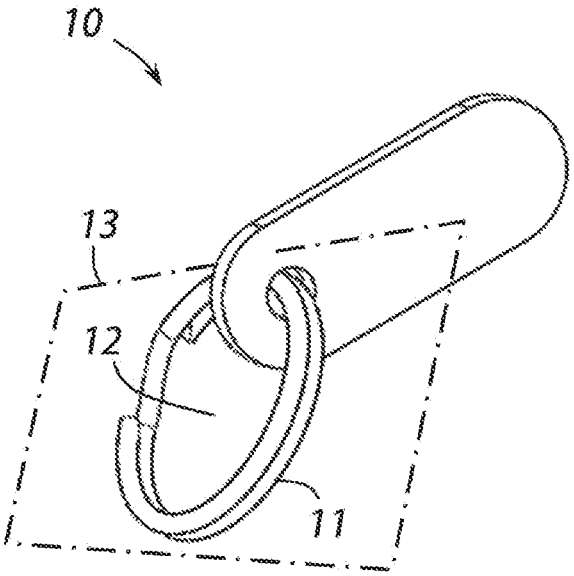
FIG. 1A is a pictorial view of a key ring having a split ring.
Figure 1B:
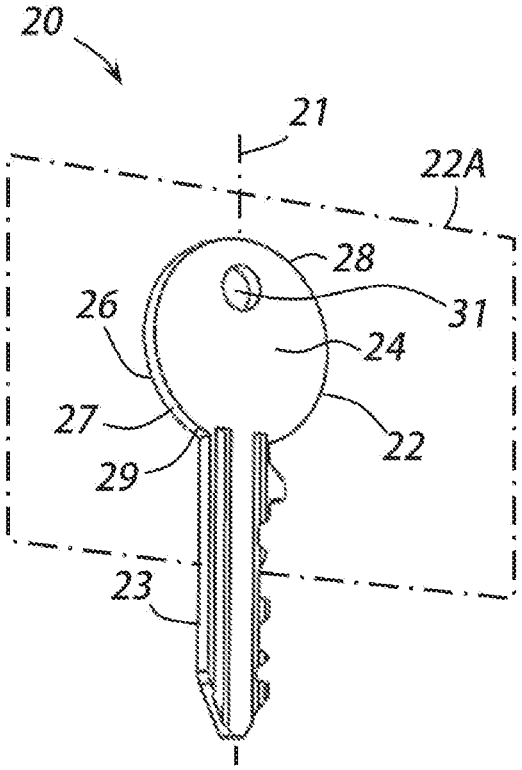
FIG. 1B is a pictorial view of a standard key having a throughgoing bore for attaching the key to a key ring's split ring.
Figure 1C:
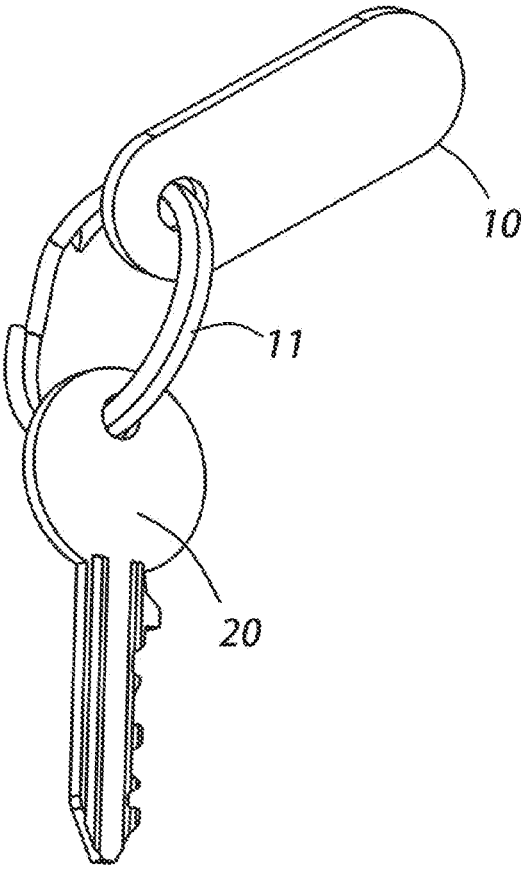
FIG. 1C is a pictorial view of the key ring with the key freely and directly suspended therefrom.

FIG. 1A shows a key ring 10 having a split ring 11 bounding a split ring aperture 12 having a split ring aperture plane 13. FIG. 1B shows a standard key 20, for example, a house key, a car ignition key, and the like. The key 20 has a longitudinal key centerline 21 and includes a generally planar keyhead 22 and a keyshank 23. The keyhead 22 has a keyhead plane 22A and can have a generally rectangular shape, a generally circular shape, a generally triangular shape, and the like. The keyhead 22 has a keyhead front surface 24, a keyhead back surface 26, and a keyhead peripheral surface 27. The keyhead peripheral surface 27 has a trailing keyhead peripheral surface 28 and a leading keyhead peripheral surface 29 with the keyshank 23 extending therefrom along the longitudinal key centerline 21. The keyhead 22 has a throughgoing bore 31 for enabling threading the key ring's split ring 11 onto the key 20. FIG. 1C shows the key 20 being freely suspended from the split ring 11 such that the keyhead plane 22A traverses the split ring aperture plane 13 and being typically transverse thereto.

Figures 2A, 2B:
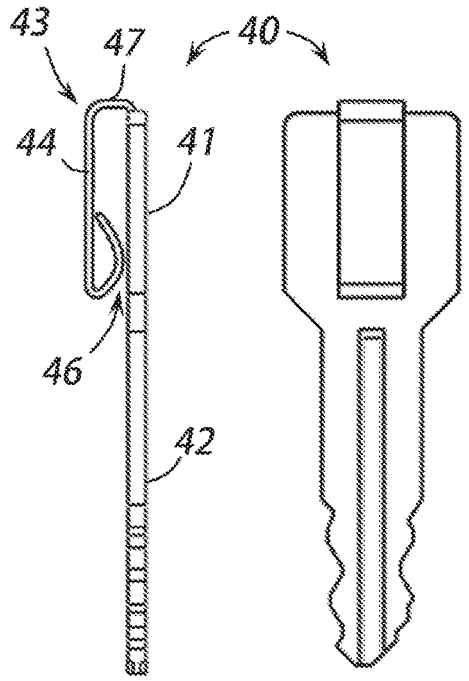
FIG.2A FIG.2B (PRIOR ART)
FIG. 2A and FIG. 2B correspond to U.S. Pat. No. 5,768,924's FIG. 1A and FIG. 1B of a first embodiment of a key clip, respectively.
Figures 3A, 3B:
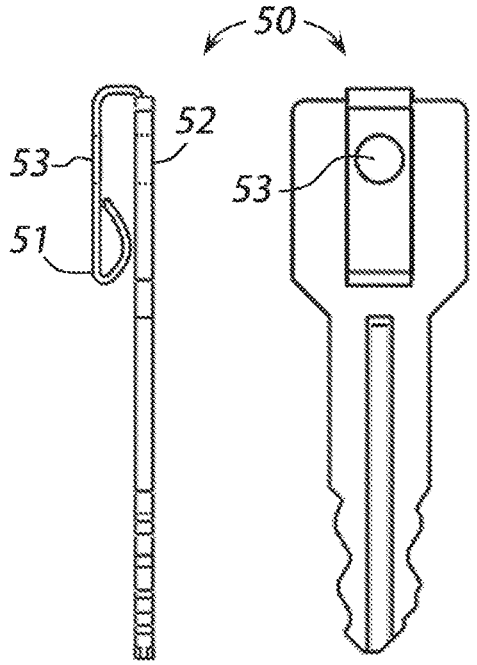
FIG.3A FIG.3B (PRIOR ART)
FIG. 3A and FIG. 3B correspond to U.S. Pat. No. 5,768,924's FIG. 5A and FIG. 5B of a second embodiment of a key clip, respectively.

FIG. 2A and FIG. 2B show a key 40 having a keyhead 41 and a keyshank 42 and a key clip 43 similar to a pen clip for clipping a pen to a clothing item's hem. The keyhead 41 is required to be specially prepared for permanent attachment of the key clip 43. The key clip 43 includes a clamping section 44 for defining a clamping zone 46 with the key 40 and a bridge section 47 for bridging between the keyhead 41 and the clamping section 44. The clamping zone 46 is concealed from view in a front elevation view of the key 40 facing the key clip 43. The bridge section 47 bends on sliding insertion of a clothing item's hem into the clamping zone 46. FIG. 3A and FIG. 3B show a key 50 similar to the key 40 and a key clip 51 similar to the key clip 43. The key 50 and key clip 51 differ from the key 40 and the key clip 43 insofar as the key 50 includes a throughgoing bore 52 similar to the throughgoing bore 31 and the key clip 51 includes a throughgoing bore 53 in registration with the throughgoing bore 52 for enabling threading the split ring 11 therethrough in a similar manner to the key 20.

Figure 4A:
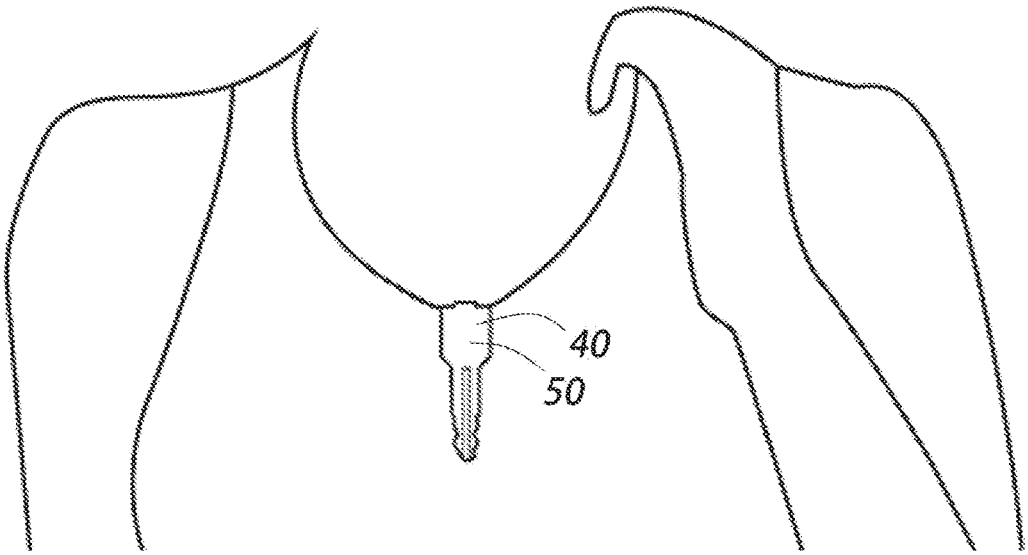
FIG.4A (PRIOR ART)
FIG. 4A is a pictorial view showing the use of the US '924's key clips for clipping a key onto a clothing item's hem.
Figure 4B:
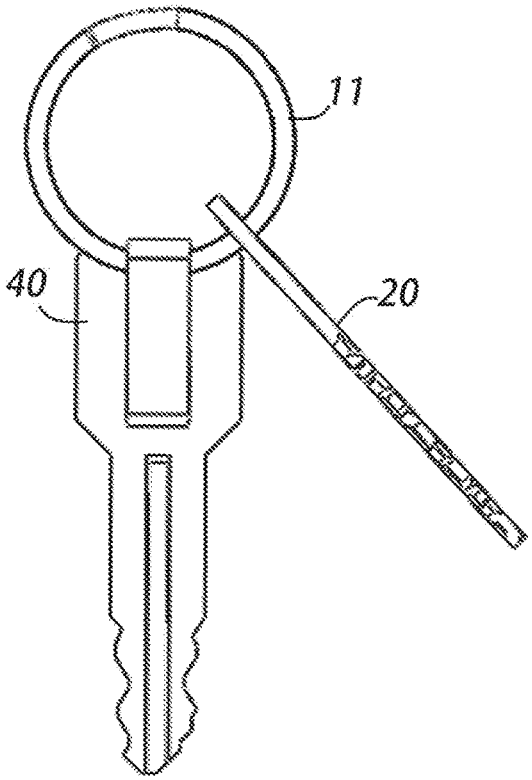
FIG.4B (PRIOR ART)
FIG. 4B is a pictorial view showing the use of the US '924's first embodiment key clip for attaching a specially prepared key to a split ring.
Figure 4C:
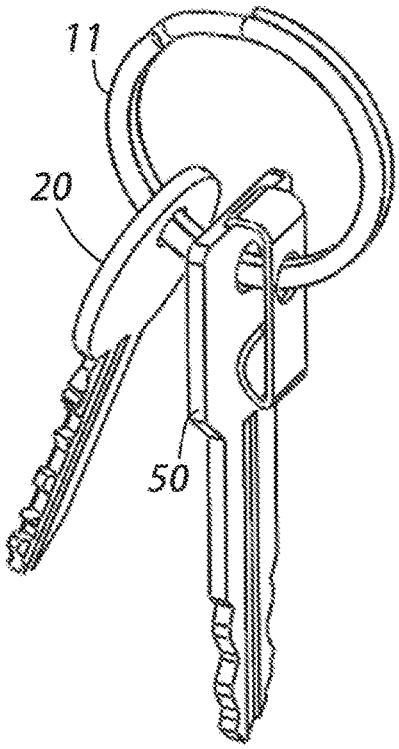
FIG.4C (PRIOR ART)
FIG. 4C is a pictorial view showing the use of the US '924's second embodiment key clip for attaching a specially prepared key to a split ring.

FIG. 4A shows the keys 40 and 50 clipped onto a clothing item's hem. FIG. 4B shows the key 40 clipped onto the split ring 11. FIG. 4C shows the key 50 threaded on the split ring 11 in a similar manner to the key 20. Comparison of FIG. 4B and FIG. 4C shows that the key 40 is awkwardly disposed on the split ring 11 such that its keyhead plane 22A is parallel to the split ring aperture plane 13 and not traverse thereto similar to the key 20. Also, the key 40 can be readily inadvertently detached from the split ring 11 leading to its loss.

Figure 5:
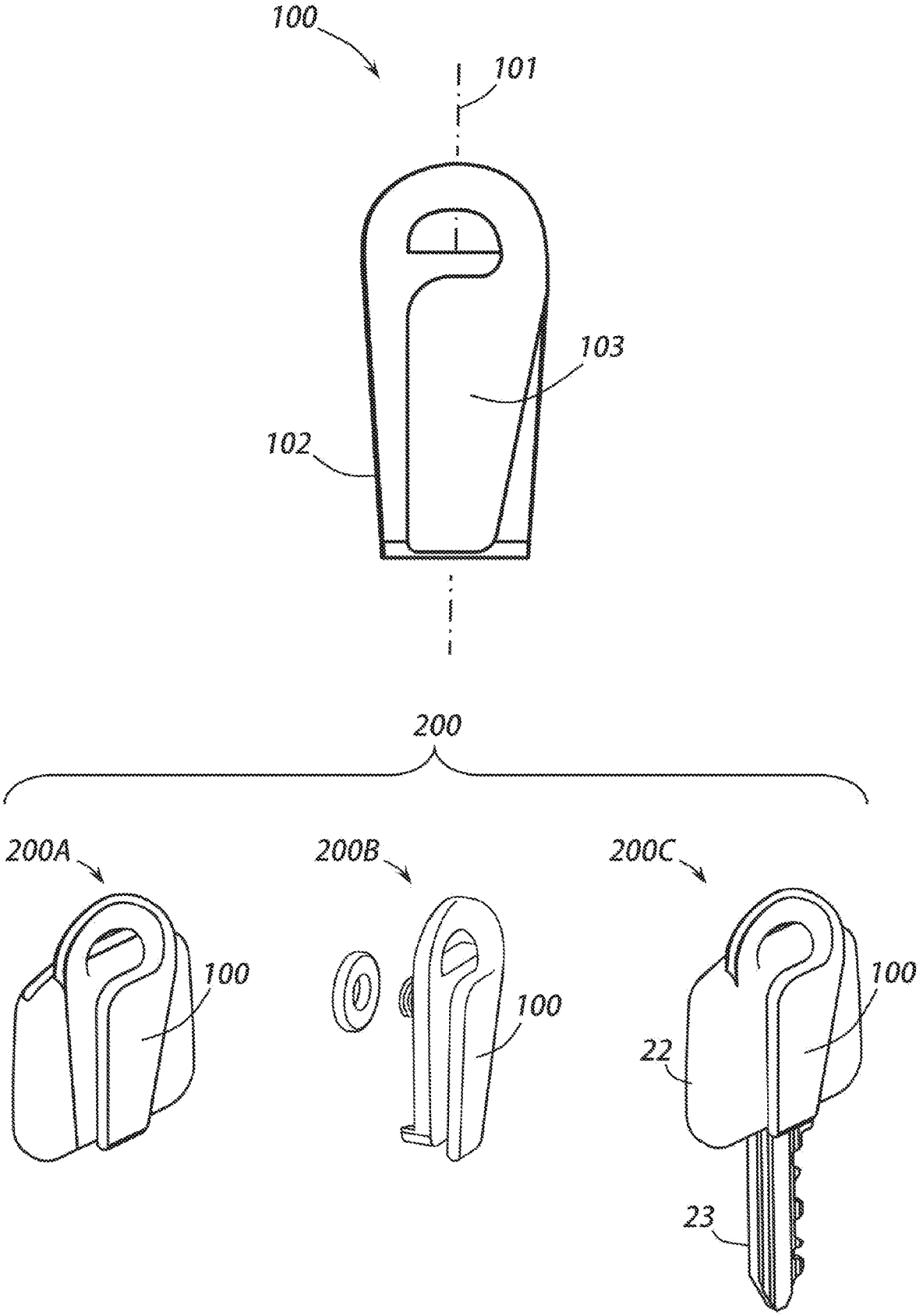
FIG. 5 is a pictorial view of three key assist devices having a common spring clip: a discrete keyhead housing for entrapping a discrete key's keyhead, a discrete keyhead connector for connecting to a discrete key's keyhead, and a clip-on key.
Figure 6:
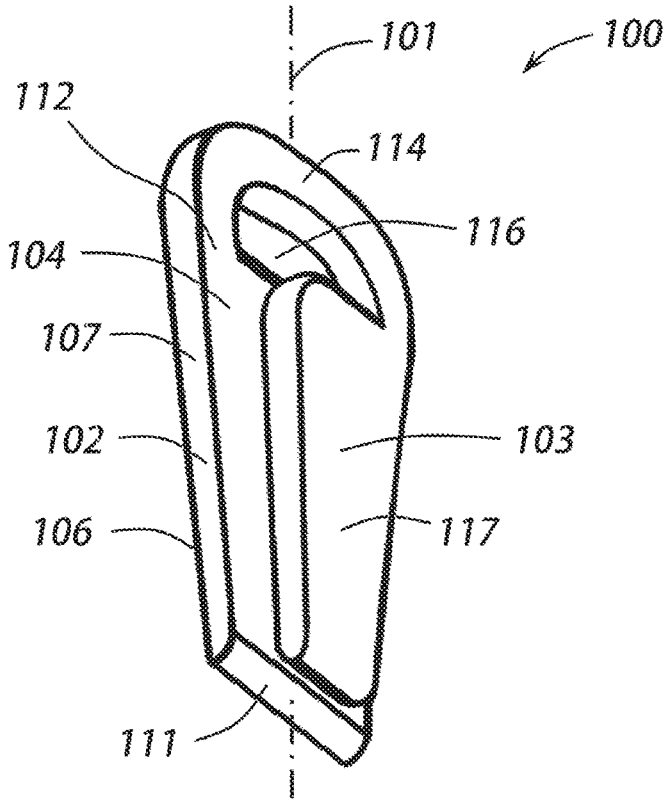
FIG. 6 is a front bottom perspective view of the spring clip.
Figure 7:
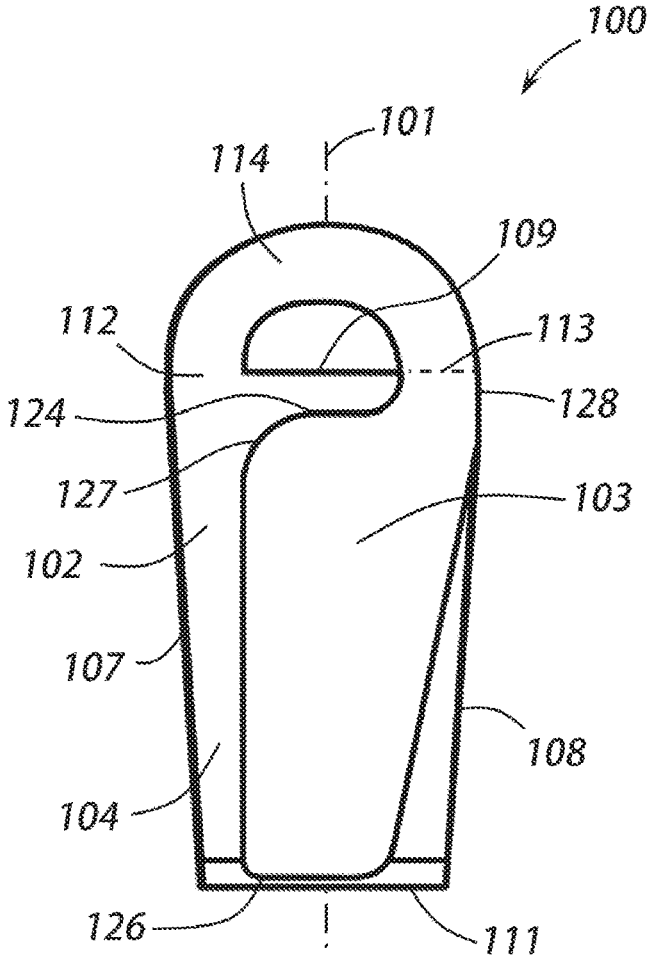
FIG. 7 is a front elevation view of the spring clip.
Figure 8A:
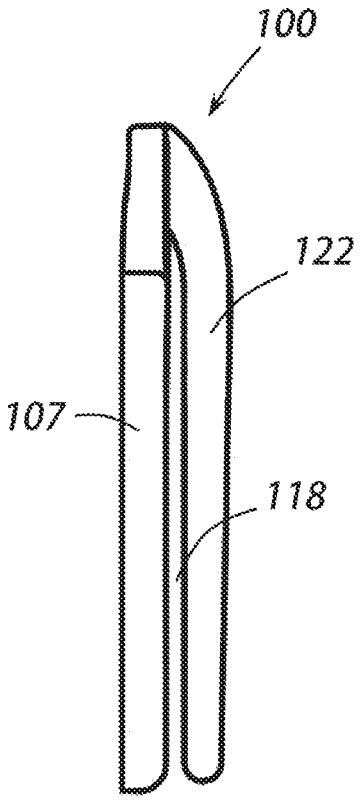
FIG. 8A is a left side elevation view of the spring clip.
Figure 8B:
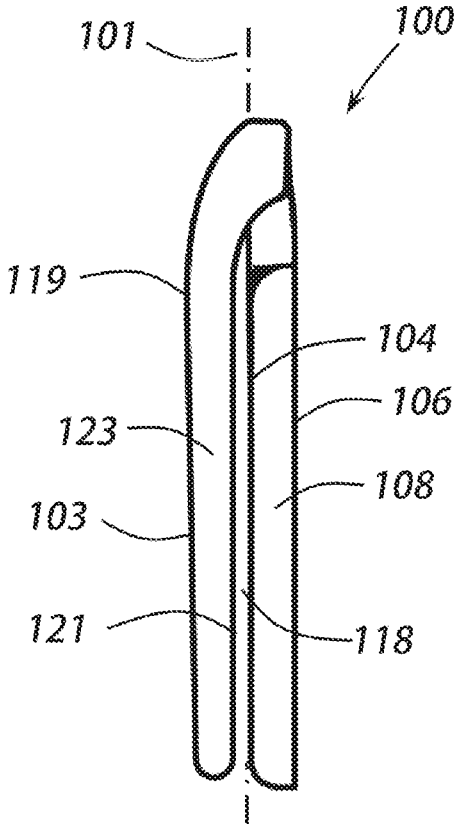
FIG. 8B is a right side elevation view of the spring clip.
Figure 9:
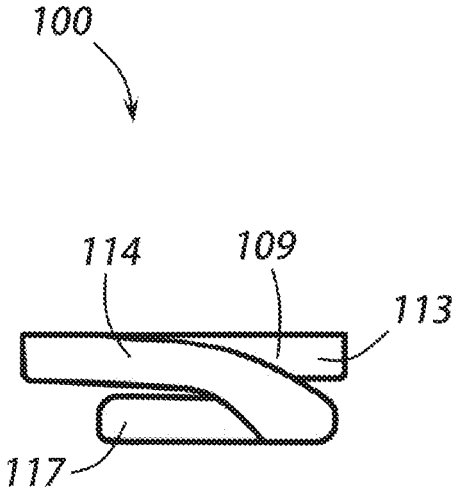
FIG. 9 is a top plan view of the spring clip.

FIG. 5 shows a spring clip 100 which can be integrally formed in three types of key assist devices 200 as follows: a discrete keyhead housing 200A for entrapping a discrete key's keyhead 22, a discrete keyhead connector 200B for connecting to a discrete key's keyhead 22 and a clip-on key 200C. The spring clip 100 has a longitudinal spring clip centerline 101 and includes an elongated planar base member 102 and a clamping member 103 resiliently flexibly mounted on the base member 102 for forming a clamping zone therebetween and preventing a split ring 11 from inadvertently being detached from the spring clip 100.

Basic Spring Clip

FIG. 6 to FIG. 9 show the spring clip 100 has the spring clip centerline 101 and includes the elongated planar base member 102 and the clamping member 103. The spring clip 100 is formed from suitable resiliently flexible material including inter alia metal, plastic, silicon, rubber, and the like. The base member 102 includes a base member front surface 104, a base member back surface 106, pair of opposite base member major side surfaces 107 and 108 co-directional with the longitudinal spring clip centerline 101, and a base member uppermost side surface 109 transverse to the longitudinal spring clip centerline 101 and an opposite base member lowermost side surface 111 transverse to the longitudinal spring clip centerline 101. The base member uppermost side surface 109 has spaced apart base member uppermost side surface ends including a base member uppermost side surface first end 112 on one side of the longitudinal spring clip centerline 101 and an opposite base member uppermost side surface second end 113 on the other side of the longitudinal spring clip centerline 101 in a front elevation view of the spring clip 100.

The clamping member 103 includes a bridge section 114 which outwardly extends with respect to the base member uppermost side surface 109 from the base member uppermost side surface first end 112 towards the base member uppermost side surface second end 113 to bound a throughgoing retaining aperture 116 substantially co-planar with the base member 102. The clamping member 103 includes an elongated planar clamping section 117 extending from the bridge section 114 co-directional with the longitudinal spring clip centerline 101 to overlie the base member front surface 104 to form a clamping zone 118 therebetween. The clamping section 117 is viewable in the spring clip 100's front elevation view thereby concealing the clamping section 118 therebehind. The throughgoing retaining aperture 116 is spaced apart from the clamping zone 118 and has a closed shape in the spring clip 100's front elevation view.

The elongated planar clamping section 117 includes a clamping section front surface 119, a clamping section back surface 121 facing the base member front surface 104, opposite clamping section side surfaces 122 and 123 co-directional with the longitudinal spring clip centerline 101, and a clamping section uppermost side surface 124 transverse to the longitudinal spring clip centerline 101 and an opposite clamping section lowermost side surface 126 transverse to the longitudinal spring clip centerline 101. The clamping section uppermost side surface 124 is substantially co-extensive with the throughgoing retaining aperture 116. The clamping section uppermost side surface 124 has spaced apart clamping section uppermost side surface ends including a clamping section uppermost side surface first end 127 on the same side of the longitudinal spring clip centerline 101 as the base member uppermost side surface first end 112 and an opposite clamping section uppermost side surface second end 128 on the same side of the longitudinal spring clip centerline 101 as the base member uppermost side surface second end 113 in the spring clip 100's front elevation view.

Keyhead Housings with Integral Spring Clip

FIG. 10 to FIG. 13 show a discrete keyhead housing 200A for use with the key ring 10, the split ring 11 with the key 20. The keyhead housing 200A has a longitudinal keyhead housing centerline 201 and includes a keyhead housing front surface 202, a keyhead housing back surface 203 and opposite keyhead housing major side surfaces 204 and 206 co-directional with the longitudinal keyhead housing centerline 201 connecting the keyhead housing front surface 202 and the keyhead housing back surface 203. The keyhead housing 200A has a keyhead housing uppermost side surface 207 transverse to the longitudinal keyhead housing centerline 201 and an opposite keyhead housing lowermost side surface 208 transverse to the longitudinal keyhead housing centerline 201. The keyhead housing 200A defines a keyhead housing cavity 209 between the keyhead housing front surface 202 and the keyhead housing back surface 203 shaped and dimensioned for snugly entrapping the keyhead 22 therein. The keyhead housing 200A can be color coded for identification purposes. The keyhead housing front surface 202 can be printed with a company name, a slogan, and the like.

The spring clip 100 is integrally formed with keyhead housing back surface 203 such that the bridge section 114 overlies the keyhead housing back surface 203. The keyhead housing 200A and the spring clip 100 can be manufactured as a single monolithic item, for example, by an inverted mold manufacturing process. Alternatively, the keyhead housing 200A and the spring clip 100 can be manufactured separately as discrete items and permanently assembled together. The keyhead housing 200A and the spring clip 100 can be formed from the same material or two different materials. The keyhead housing 200A is typically formed from a material more flexibly resilient than the spring clip 100.

The keyhead housing 200A is formed with a keyhead housing major slot 211 in the keyhead housing uppermost side surface 207 and a keyhead housing minor slot 212 in the keyhead housing lowermost side surface 208 opposite the keyhead housing major slot 211 and midway therealong. The keyhead housing major slot 211 typically extends along the keyhead housing uppermost side surface 207 and is shaped and dimensioned similar to the keyhead 22. The keyhead housing minor slot 212 is shaped and dimensioned for snug sliding passage of the keyshank 23 therethrough.

Figure 14A:
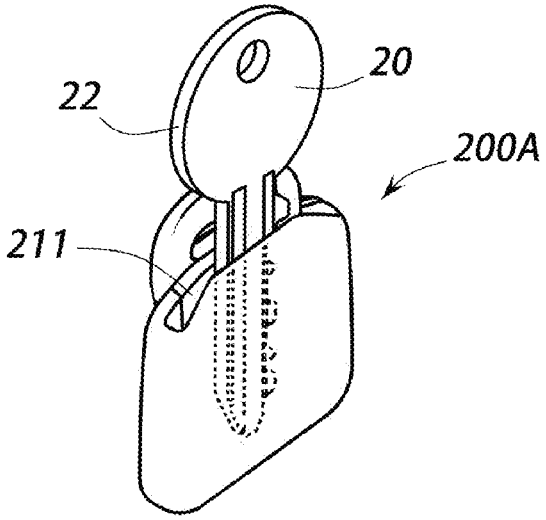
FIG. 14A and FIG. 14B are pictorial views showing a partial insertion of a key into the FIG. 10 keyhead housing and a full insertion of the key into the FIG. 10 key housing, respectively.
Figure 14B:
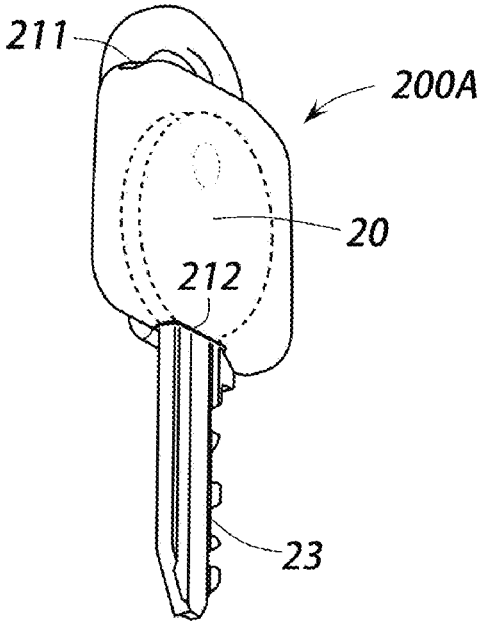

FIG. 14A and FIG. 14B show a partial insertion of a key 20 into a keyhead housing 200A and a full insertion of the key 20 into the key housing 200A, respectively. FIG. 14A shows a user initially inserting the keyshank 23 through the keyhead housing major slot 211 into the keyhead housing cavity 209 towards the keyhead housing minor slot 212. FIG. 14B shows the user fully inserting the keyhead 22 into the keyhead housing 200A which snugly entraps the keyhead 22 therein such that keyshank 23 extends through the keyhead housing minor slot 212 co-directional with the longitudinal key housing centerline 201.

Figure 15A:
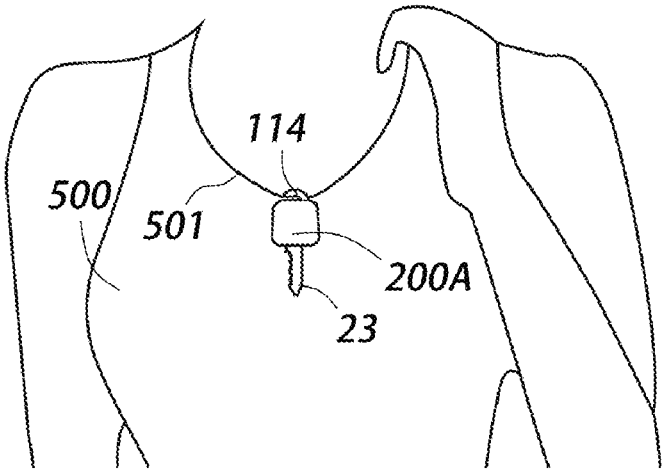
FIG. 15A is a pictorial view showing the FIG. 10 keyhead housing with an entrapped key clamped on a clothing item hem.
Figure 15B:
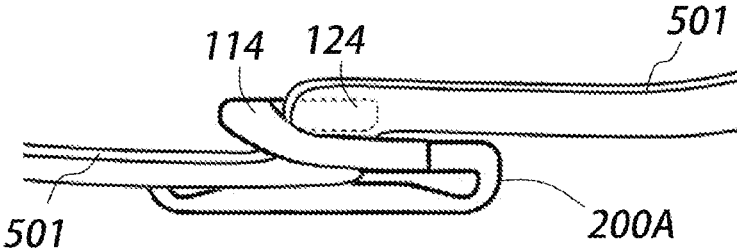
FIG. 15B is a top elevation view of FIG. 15A.

FIG. 15A and FIG. 15B show a user clamping the keyhead housing 200A and its entrapped key 20 on a clothing item 500 having a clothing item hem 501 by slidingly inserting the clothing item hem 501 through the clamping zone 118 between the keyhead housing back surface 203 and the clamping member 103 towards the throughgoing retaining aperture 116. The clothing item hem 501 is preferably inserted towards the bridge section 114 such that the clothing item hem 501 extends lengthwise through the throughgoing retaining aperture 116 thereby overlying the clamping section uppermost side surface 124 shown in dashed lines. The clothing item hem 501 assumes a zigzag shape thereby ensuring a more secure clamping than compared to the aforementioned US '934's key clips.

Figure 16A:
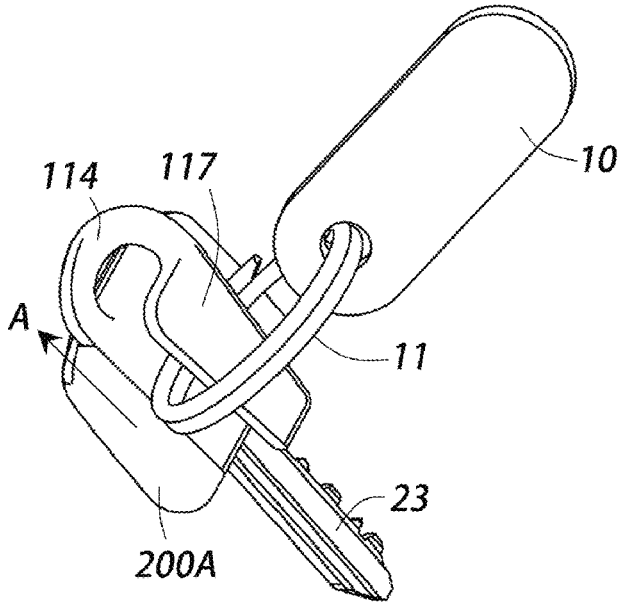
FIG. 16A, FIG. 16B and FIG. 16C show a user attaching the FIG. 10 keyhead housing with an entrapped key to a key ring's split ring.
Figure 16B:
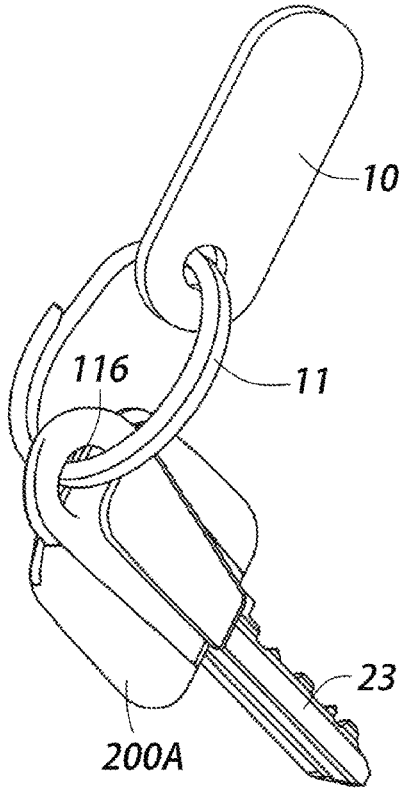
Figure 16C:
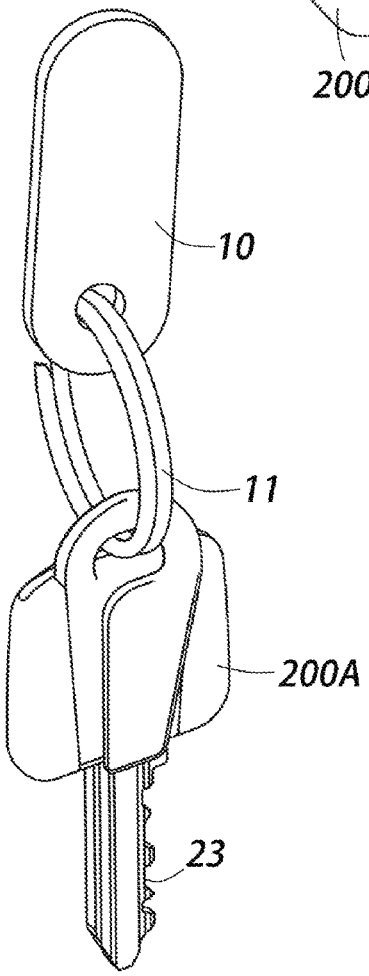
Figure 17:
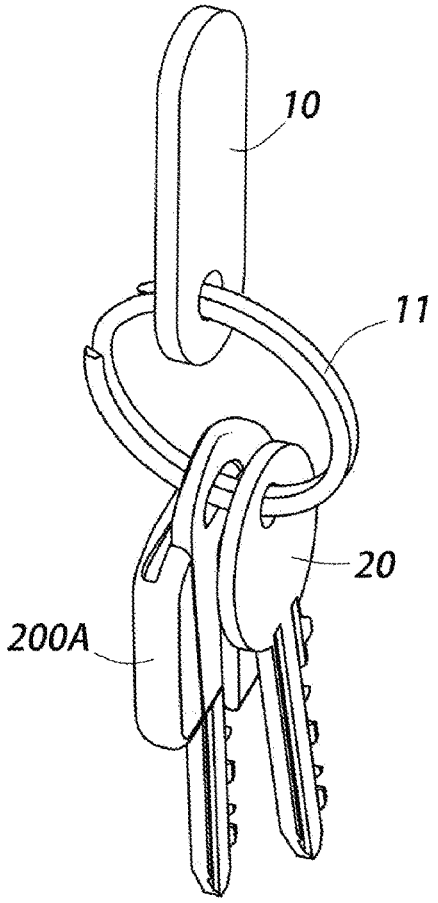
FIG. 17 is a pictorial view of a key ring with the FIG. 10 keyhead housing with an entrapped key and a standard key freely and directly suspended therefrom.

FIG. 16A to FIG. 16C show a user attaching the keyhead housing 200A and its entrapped key 20 onto a key ring's split ring 11 as follows: FIG. 16A shows the user slidingly inserting the split ring 11 between the keyhead housing back surface 203 and the clamping section 117 through the clamping zone 118 towards the bridge section 114 as denoted by arrow A by elastically deforming the bridge section 114. The bridge section 114 undergoes torsion as opposed to bending in the case of the keys 40 and 50. FIG. 16B shows the user slidingly inserting the split ring 11 into the throughgoing retaining aperture 116 whereupon the bridge section 114 reverts to its non-deformed shape. FIG. 16C shows the key housing 200A and the entrapped key 20 suspended from the key ring 10 such that the keyhead housing 200A is traverse to the split ring 11 to assume the same position as a standard key 20 (see FIG. 1C). FIG. 17 shows the keyhead housing 200A aligned with the standard key 20 with its keyhead plane 22A traversing the split ring aperture plane 13.

Figure 18A:
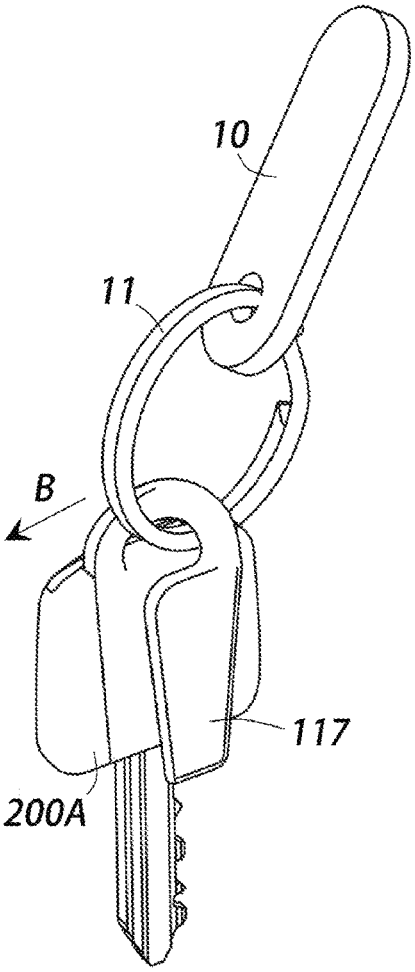
FIG. 18A and FIG. 18B show a user detaching the FIG. 10 keyhead housing with an entrapped key from a key ring's split ring.
Figure 18B:
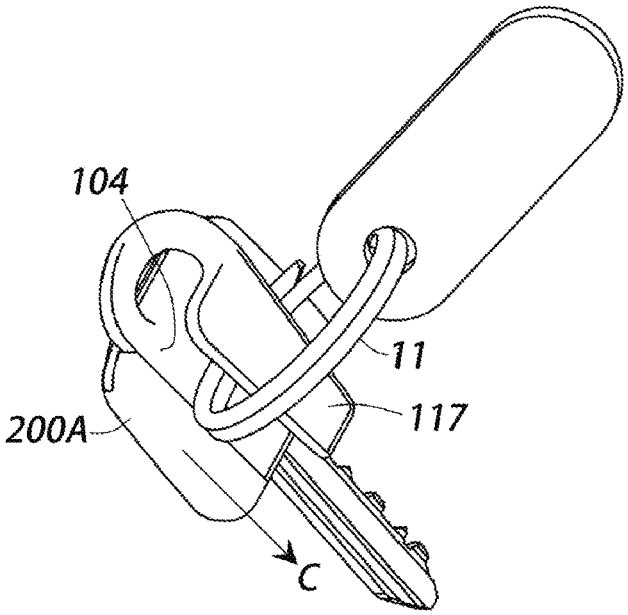

FIG. 18A and FIG. 18B show a user detaching the keyhead housing 200A and the entrapped key 20 from the key ring's split ring 11. FIG. 18A shows the user sliding the split ring 11 towards the base member uppermost side surface second end 113 and then directing the split ring 11 through the clamping zone 118 while applying the split ring 11 to elastically deform the bridge section 114 at its juncture with the clamping section 117 such that the user can urge the split ring 11 out of the throughgoing retaining aperture 116 as denoted by arrow B. Such a simultaneous double-action manipulation of the split ring 11 out of the throughgoing retaining aperture 116 precludes inadvertent detachment of the keyhead housing 220 and the entrapped key 20 from the split ring 11. FIG. 18B shows the user sliding the split ring 11 between the base member front surface 104 and the clamping section 117 towards the base member lowermost side surface 111 as denoted by arrow C until the keyhead housing 200A is detached from the split ring 11.

Figure 19A:
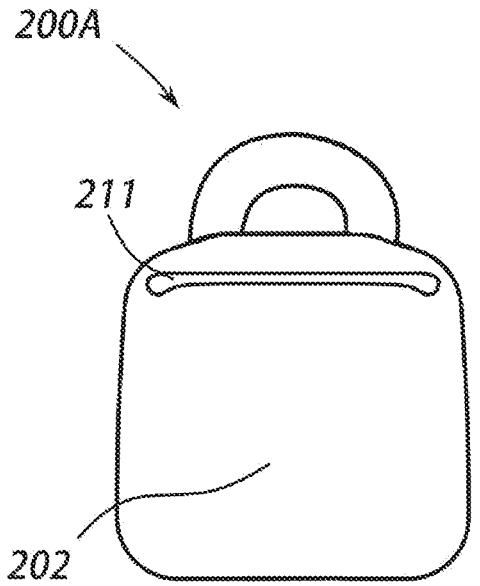
FIG. 19A, FIG. 19B and FIG. 19C are pictorial views showing alternative embodiments of FIG. 10 keyhead housings with different deployed keyhead housing major slots.
Figure 19B:
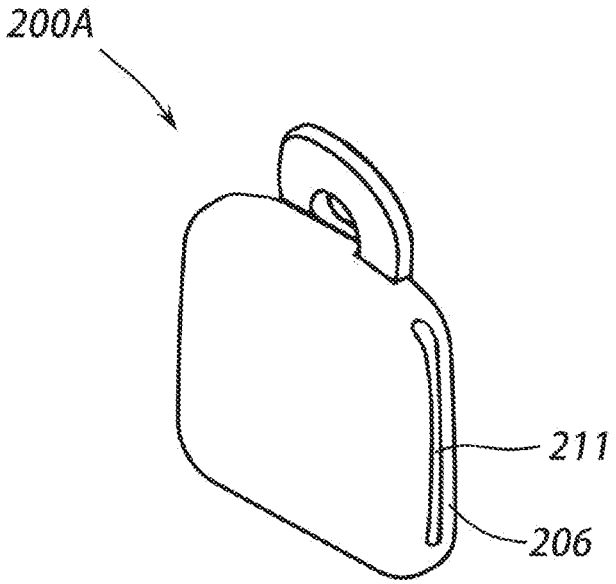
Figure 19C:
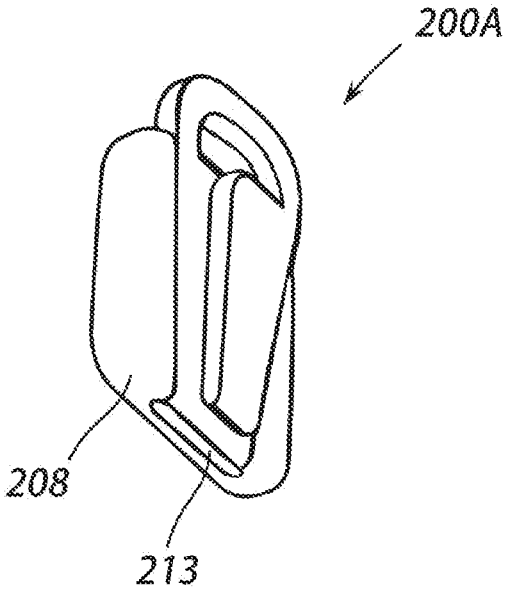

FIG. 19A, FIG. 19B and FIG. 19C show alternative embodiments of keyhead housings 200A as follows: FIG. 19A shows a keyhead housing 200A with a keyhead housing major slot 211 formed in the keyhead housing front surface 202 instead of the keyhead housing uppermost side surface 207. FIG. 19B shows a keyhead housing 200A with a keyhead housing major slot 211 formed in the keyhead housing major side surface 206 instead of the keyhead housing uppermost side surface 207. FIG. 19C shows a keyhead housing 200A with a single keyhead housing slot 213 in the keyhead housing lowermost side surface 208 through which the keyhead 22 is inserted therethrough into the keyhead housing cavity 209. The FIG. 19C keyhead housing 200A is necessarily formed from more stretchable material than the FIG. 10, FIG. 19A, and FIG. 19B keyhead housings 200A.

Figure 20A:
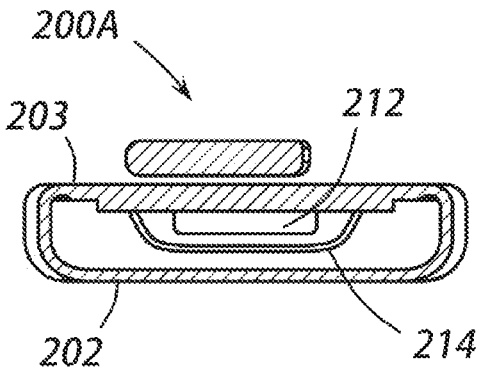
FIG. 20A and FIG. 20B are transverse cross sections of the FIG. 10 keyhead housing with an internal spacer for use with thin keys before and after insertion of a thin key thereinto, respectively, along line A-A in FIG. 10.
Figure 20B:
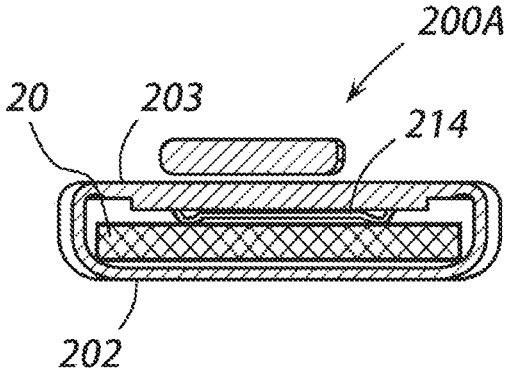

FIG. 20A and FIG. 20B show the keyhead housing 200A includes an internal spacer 214 on the inside surface of the keyhead housing back surface 203 for reducing the dimension of the keyhead housing cavity 209 between the keyhead housing front surface 202 and the keyhead housing back surface 203. FIG. 20B shows the internal spacer 214 ensures that a thin key 20 is snugly entrapped in the keyhead housing 200A.

Figure 21A:
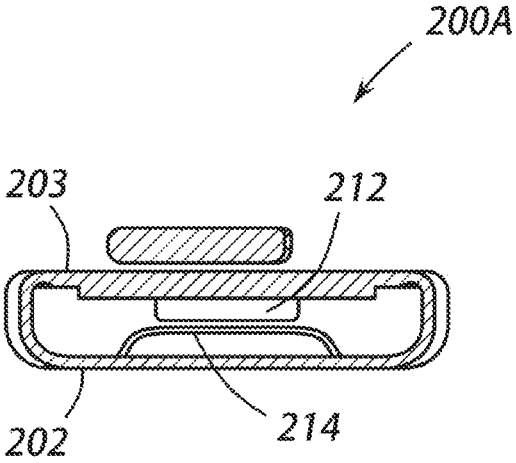
FIG. 21A and FIG. 21B are transverse cross sections of the FIG. 10 keyhead housing with an alternative internal spacer for use with thin keys before and after insertion of a thin key thereinto, respectively, along line A-A in FIG. 10.
Figure 21B:
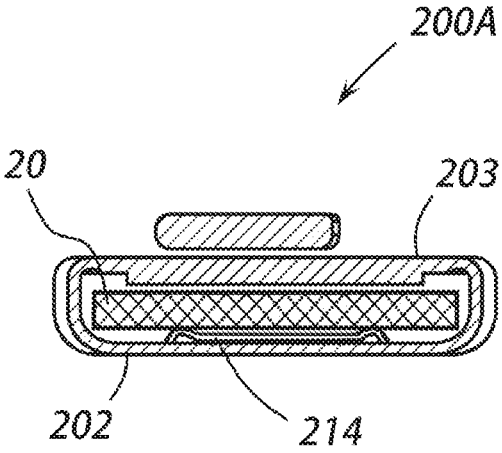

FIG. 21A and FIG. 21B show the keyhead housing 200A with the internal spacer 214 on the inside surface of the keyhead housing front surface 202 instead of the keyhead housing back surface 203.

Figure 10:
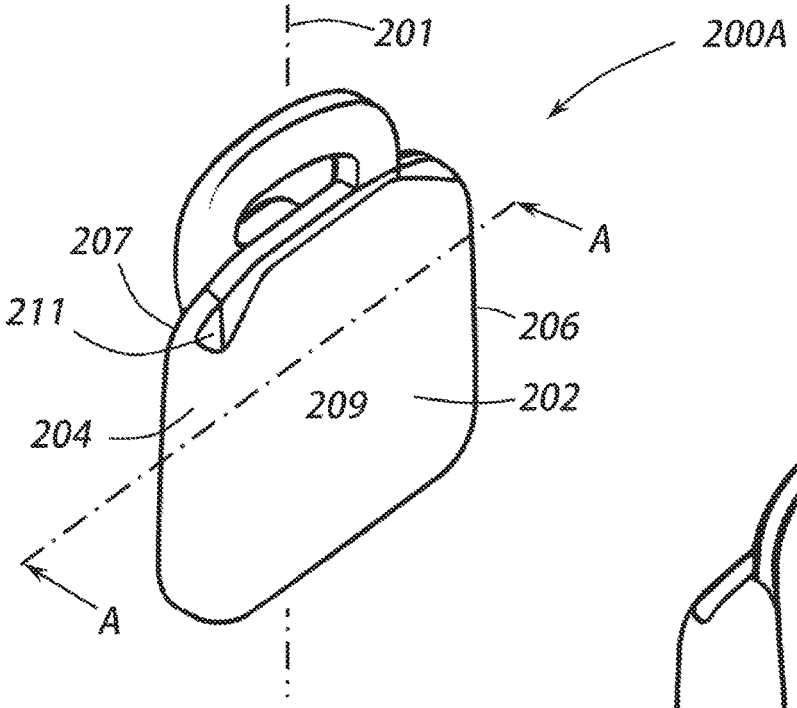
FIG. 10 is a front top perspective view of a keyhead housing integrally formed with the spring clip.
Figure 11:
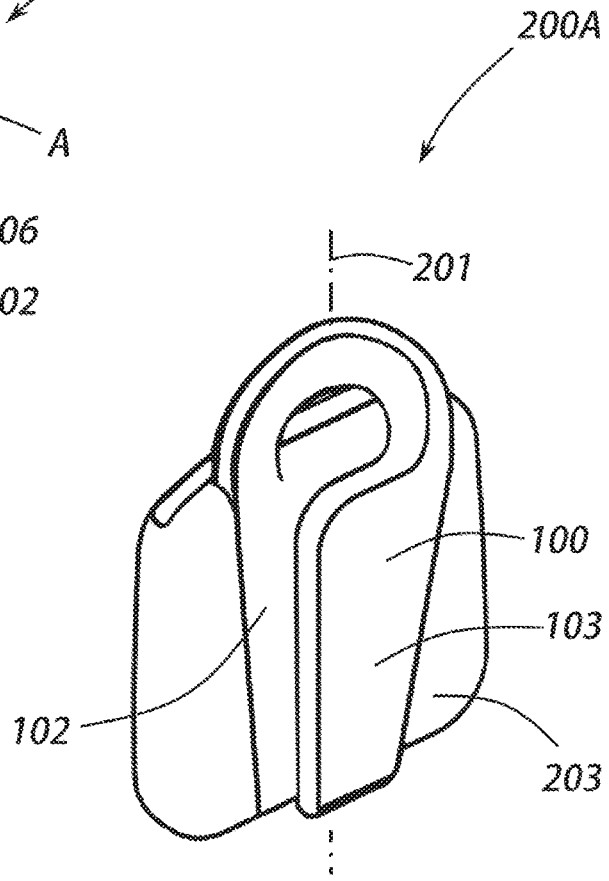
FIG. 11 is a rear top perspective view of the keyhead housing.
Figure 12:
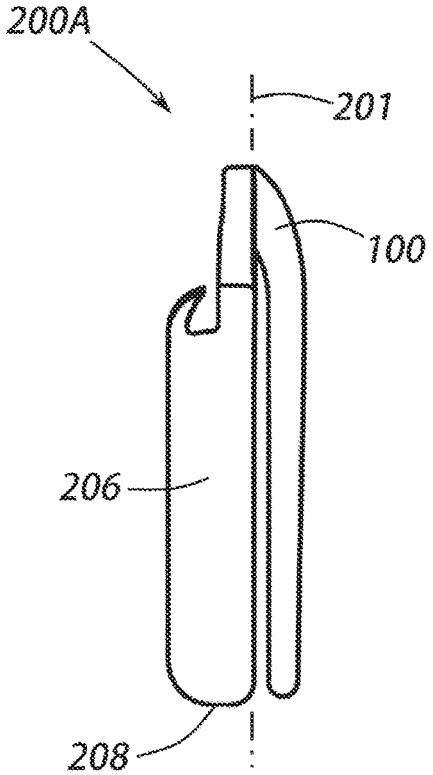
FIG. 12 is a right side elevation view of the keyhead housing.
Figure 13:
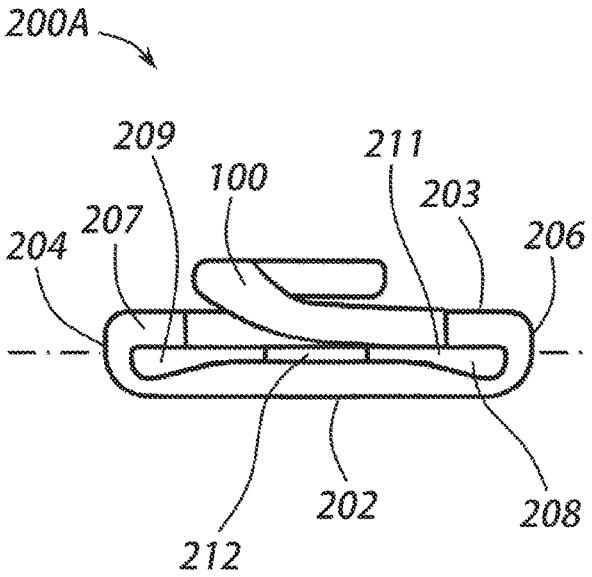
FIG. 13 is a top plan view of the keyhead housing.
Figure 22A:
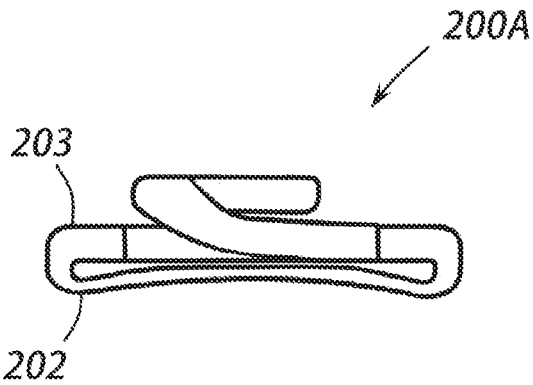
FIG. 22A and FIG. 22B are top plan views of yet another embodiment of a keyhead housing for use with thin keys before and after insertion of a thin key thereinto, respectively.
Figure 22B:
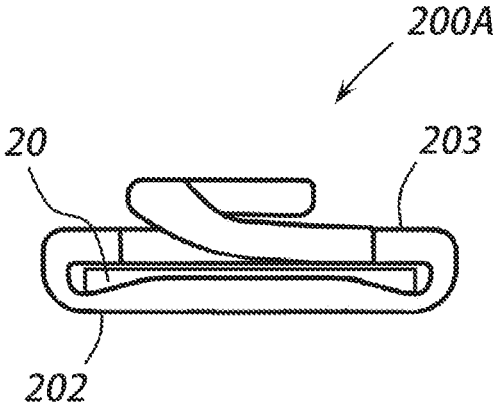

FIG. 22A and FIG. 22B show the keyhead housing 200A with a keyhead housing front surface 202 arched inwards towards the keyhead housing back surface 203 to reduce the dimension of the keyhead housing cavity 209 between the keyhead housing front surface 202 and the keyhead housing back surface 203 compared to the FIG. 10 keyhead housing 200A. FIG. 22B shows the thin key 20 urges the keyhead housing front surface 202 away from the keyhead housing back surface 203 such that the keyhead housing 200A snugly entraps the thin key 20.

Figure 23:
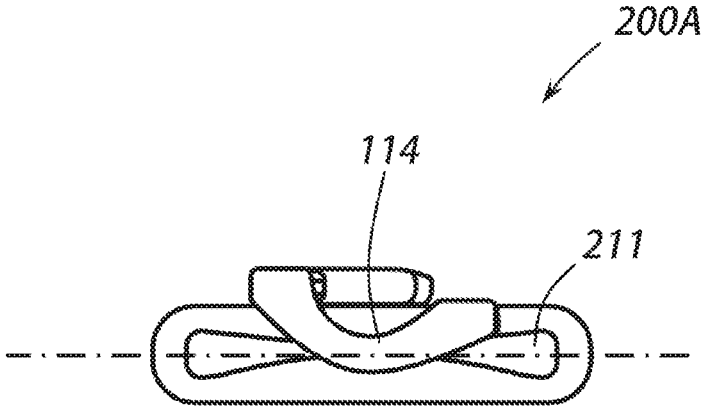
FIG. 23 is a top plan view of a keyhead housing with a bridge section overlying its keyhead housing major slot.

FIG. 23 shows a keyhead housing 200A in which the bridge section 114 is shaped to overly the keyhead housing major slot 211 as compared to the FIG. 10 keyhead housing 200A to prevent the keyhead 22 from sliding back out through the keyhead housing major slot 211.

Figure 24:
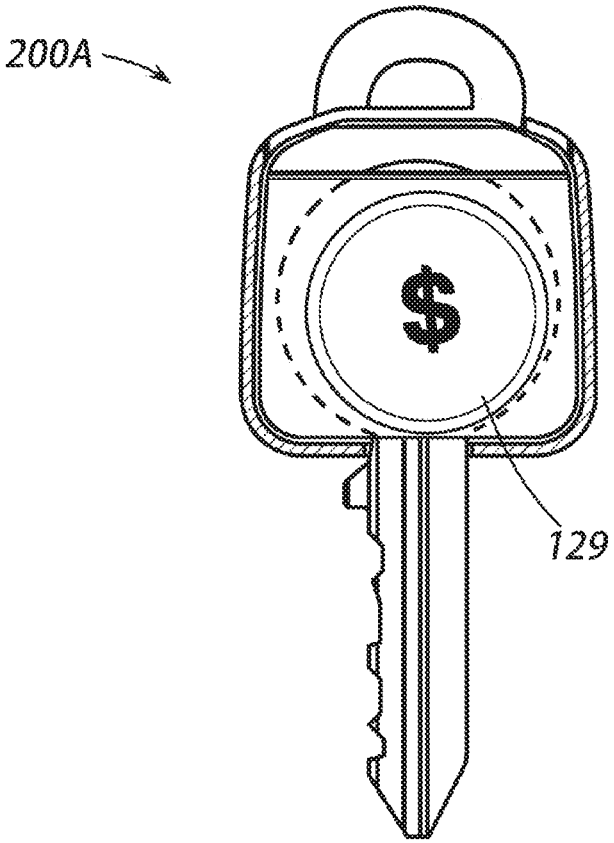
FIG. 24 is a front elevation view of a keyhead housing with a pocket to receive a coin.

FIG. 24 shows a keyhead housing 200A with a pocket 129 to receive a coin.

Keyhead Connector with Integral Spring Clip

Figure 25A:
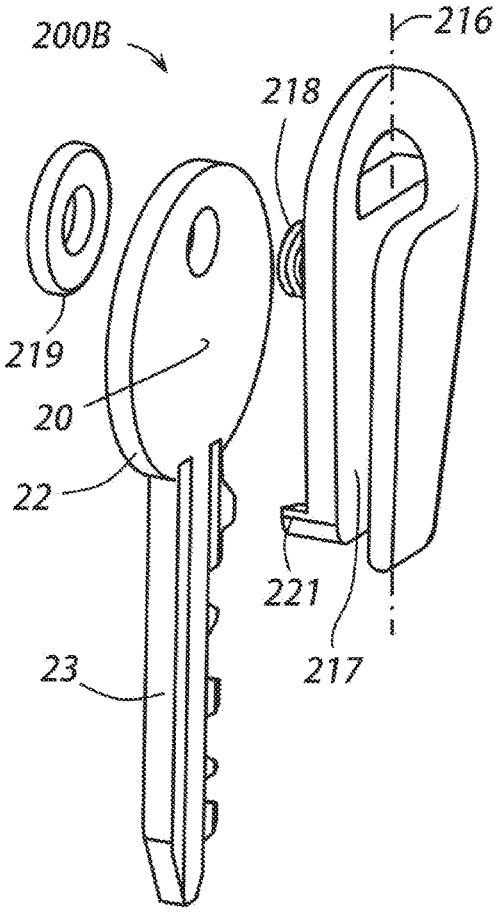
FIG. 25A and FIG. 25B are pictorial views of a keyhead connector for connecting to a key's keyhead before and after connection, respectively.
Figure 25B:
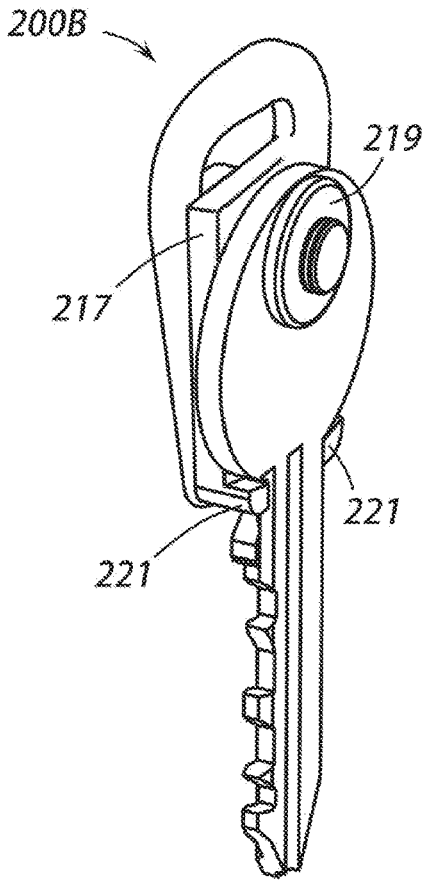

FIG. 25A and FIG. 25B show a keyhead connector 200B for connecting to a keyhead 22 before and after connection, respectively. The keyhead connector 200B has a longitudinal keyhead connector centerline 216 and includes a keyhead connector support 217 with a transverse directed pin 218 for insertion through the key's throughgoing bore 31, and a keyhead connector closure 219 for mounting on the transverse directed pin 218 for securing the key 20 on the keyhead connector 200B. The keyhead connector support 217 is integrally formed with the spring clip 100 such that the keyhead connector 200B can be used in a similar manner as the keyhead housing 200A. The keyhead connector support 217 is formed with a pair of spaced apart retaining pins 221 for entrapping the keyshank 23 therebetween for ensuring the key 20 is immobilized with respect to the keyhead connector 200B.

Clip-on Key with Integral Spring Clip

Figure 26:
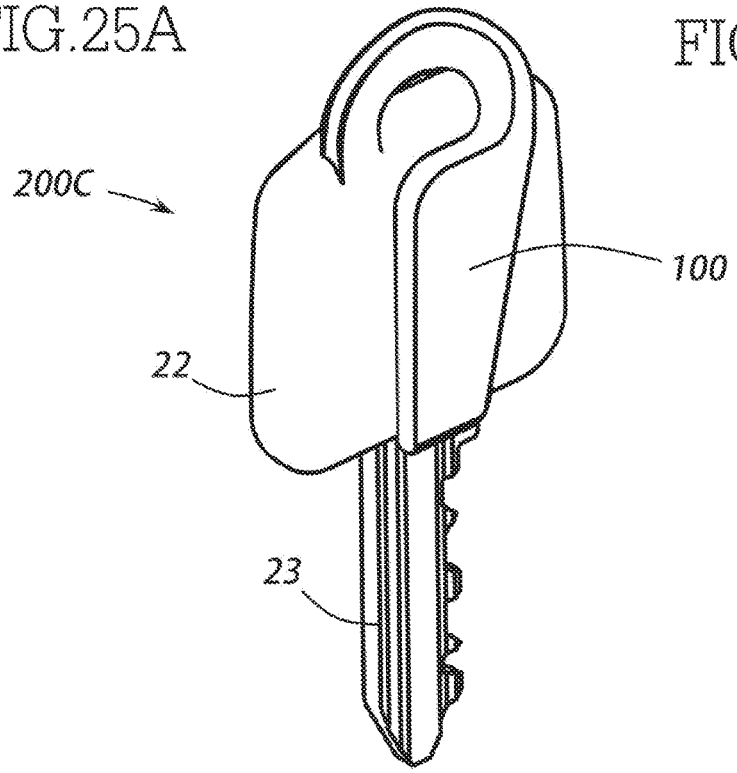
FIG. 26 is a pictorial view of a clip-on key having a keyhead with an integral spring clip.

FIG. 26 shows a clip-on key 200C having a keyhead 22 with an integral spring clip 100 and a keyshank 23 wherein the keyhead 22 is effectively the elongated planar base member 102 whereby the clip-on key 200C can be used in a similar manner as the keyhead housing 200A. The keyhead 22 and the clamping member 103 can be formed as a unitary body in a single manufacturing process. Alternatively, the keyhead 22 and the clamping member 103 can be formed as discrete items which are integrally attached using rivets, adhesives, welding, and the like.

Additional Key Assist Device Embodiments

For the purpose of conciseness, the additional key assist device embodiments are described with reference to the keyhead housing 200A but they can be equally applied to the keyhead connector 200B and the clip-on key 200C.

Figure 27:
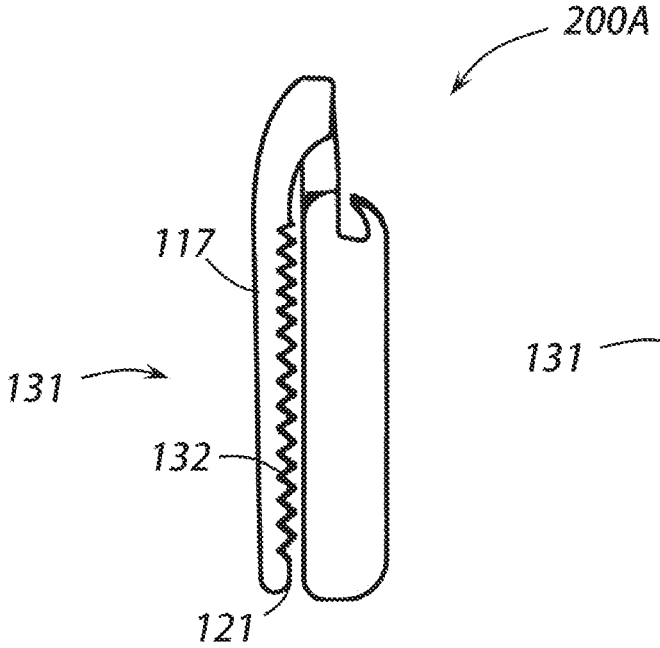
FIG. 27 to FIG. 30 are left side elevation views of keyhead housings including a grip feature for gripping a clothing item.
Figure 28:
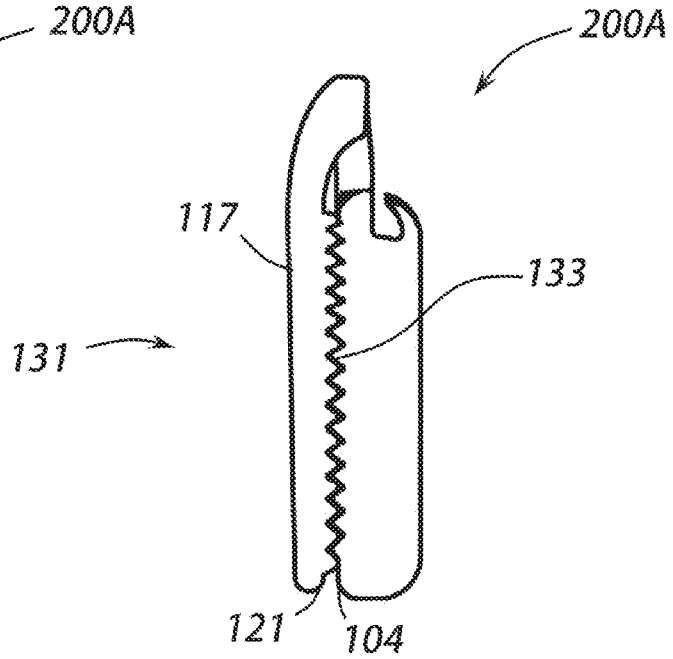
Figure 29:
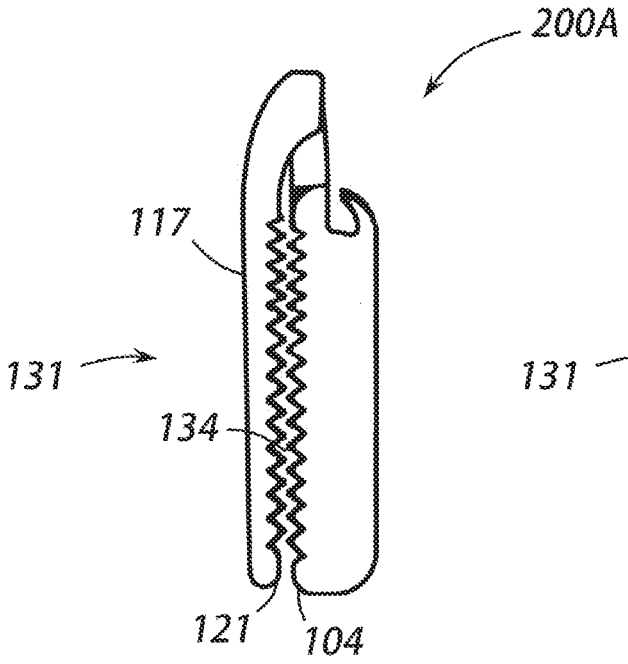
Figure 30:
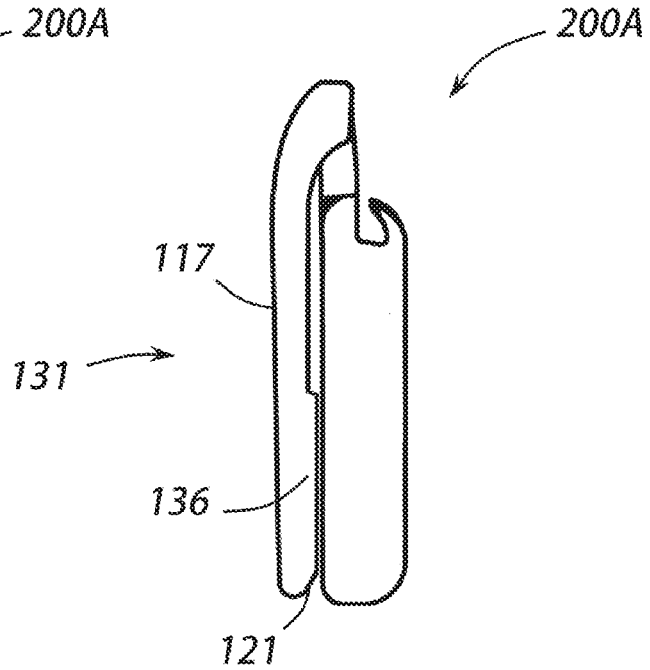

FIG. 27 to FIG. 30 show keyhead housings 200A including a clamping zone 118 with a grip feature 131 for gripping a clothing item. FIG. 27 shows the clamping section back surface 121 formed with a grip array 132 implementing the grip feature 131. FIG. 28 shows the base member front surface 104 and the clamping section back surface 121 formed with mating grip arrays 133 implementing the grip feature 131. FIG. 29 shows the base member front surface 104 and the clamping section back surface 121 formed with spaced apart grip arrays 134 implementing the grip feature 131. FIG. 30 shows the clamping section back surface 121 formed with a bulbous end 136 implementing the grip feature 131.

Figure 31:
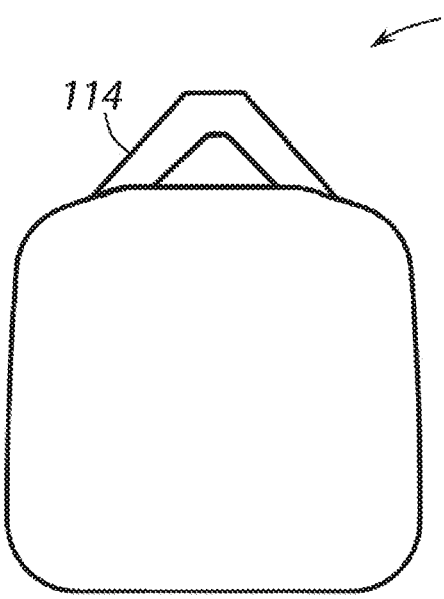
FIG. 31 is a front elevation view of a keyhead housing including a trapezoidal shaped bridge section.
Figure 32:
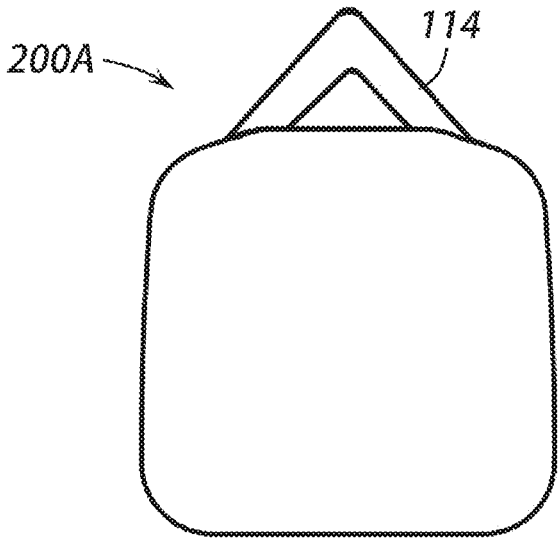
FIG. 32 is a front elevation view of a keyhead housing including a triangular shaped bridge section.

FIG. 31 shows a keyhead housing 200A including a trapezoidal shaped bridge section 114 and FIG. 32 shows a keyhead housing 200A including a triangular shaped bridge section 114.

Figure 33:
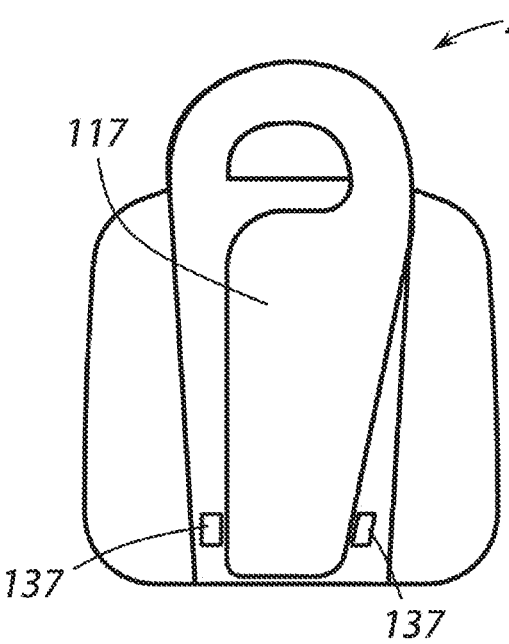
FIG. 33 is a rear elevation view of a keyhead housing with a first arrangement of spaced apart pair of retaining projections for retaining its clamping section with respect thereto.
Figure 34:
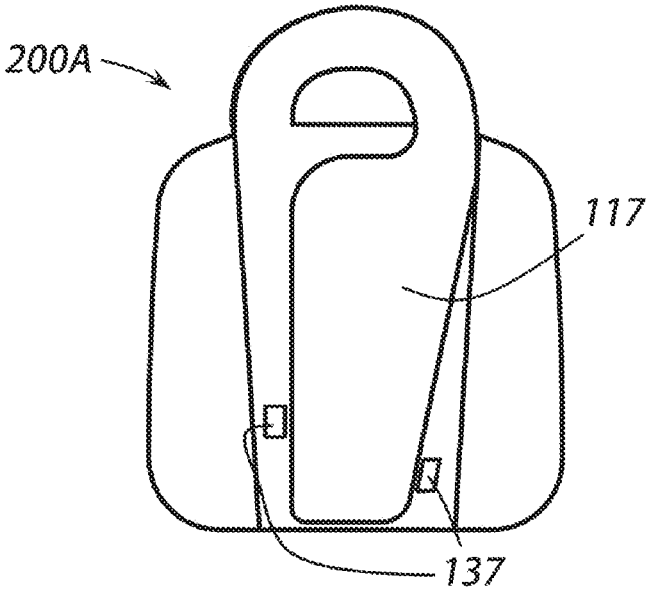
FIG. 34 is a rear elevation view of a keyhead housing with a second arrangement of spaced apart pair of retaining projections for retaining its clamping section with respect thereto.

FIG. 33 and FIG. 34 show keyhead housings 200A with a spaced apart pair of retaining projections 137 for retaining its clamping section 117 therebetween. FIG. 33 shows an opposite pair of retaining projections 137 and FIG. 34 shows a staggered pair of retaining projections 137.

Figure 35:
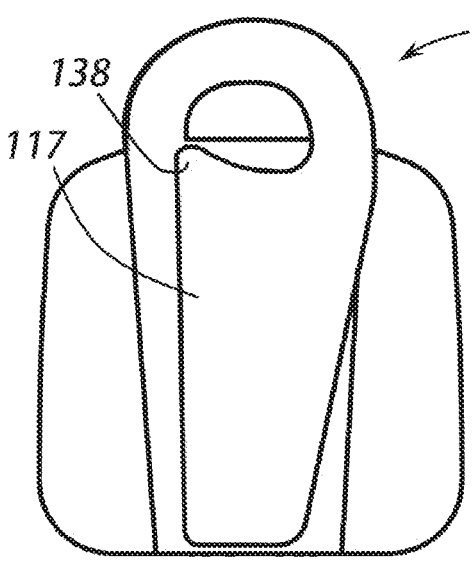
FIG. 35 to FIG. 42 are rear elevation views of keyhead housings with different shaped clamping members.
Figure 36:
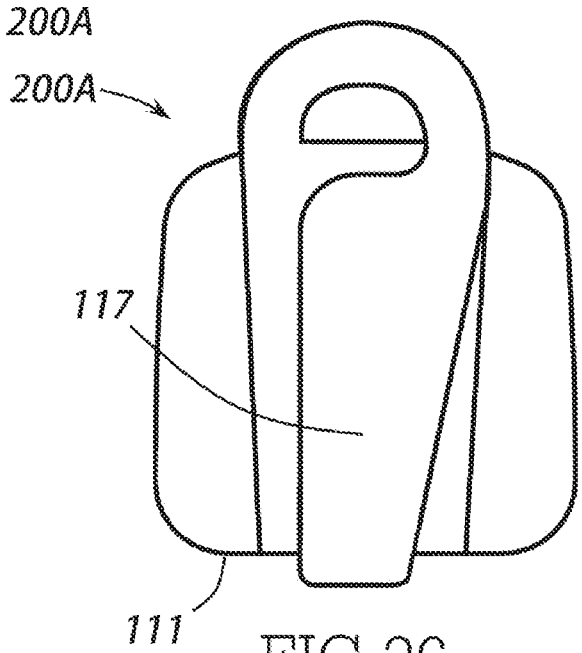
Figure 37:
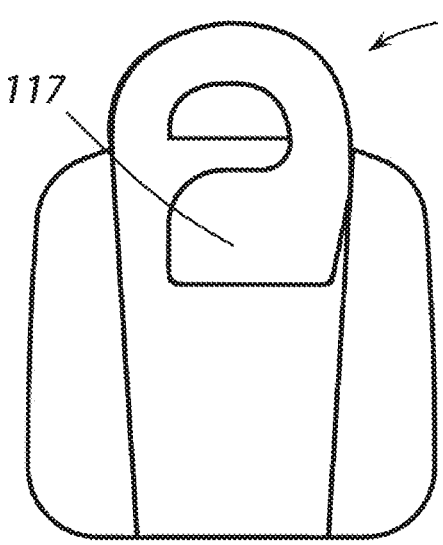
Figure 38:
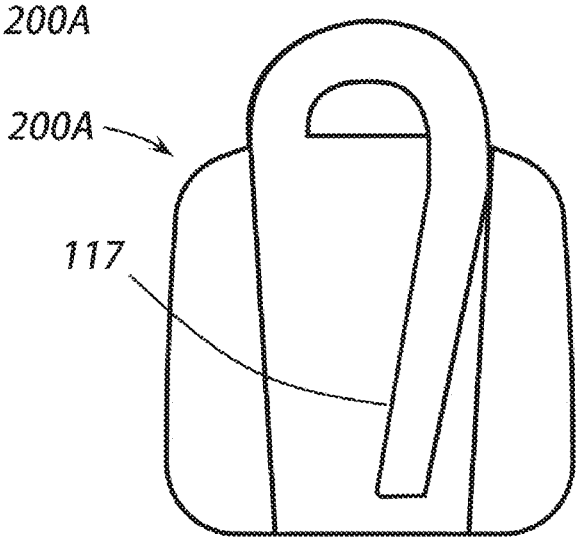
Figure 39:
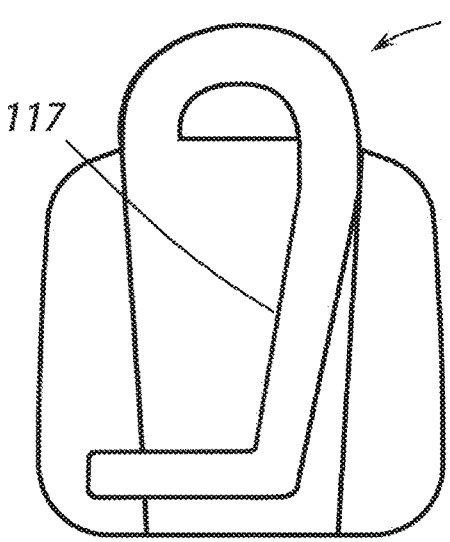
Figure 40:
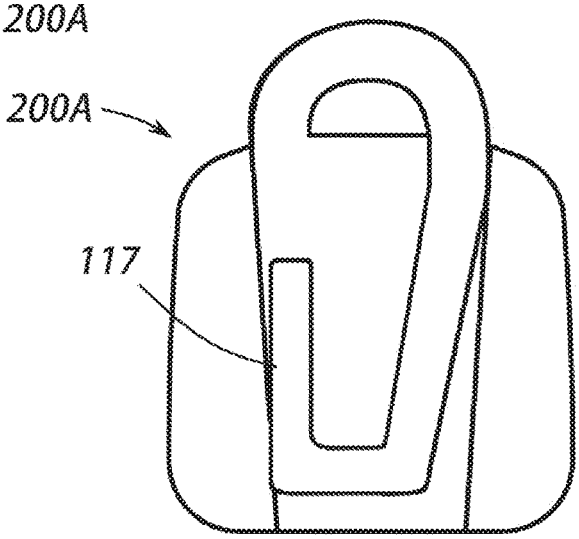
Figure 41:
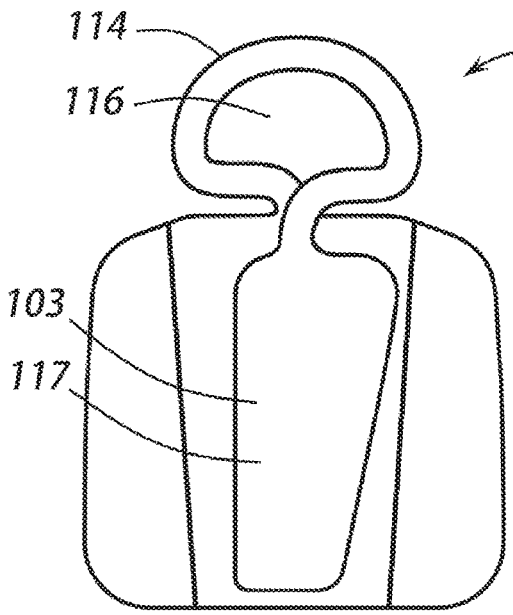
Figure 42:
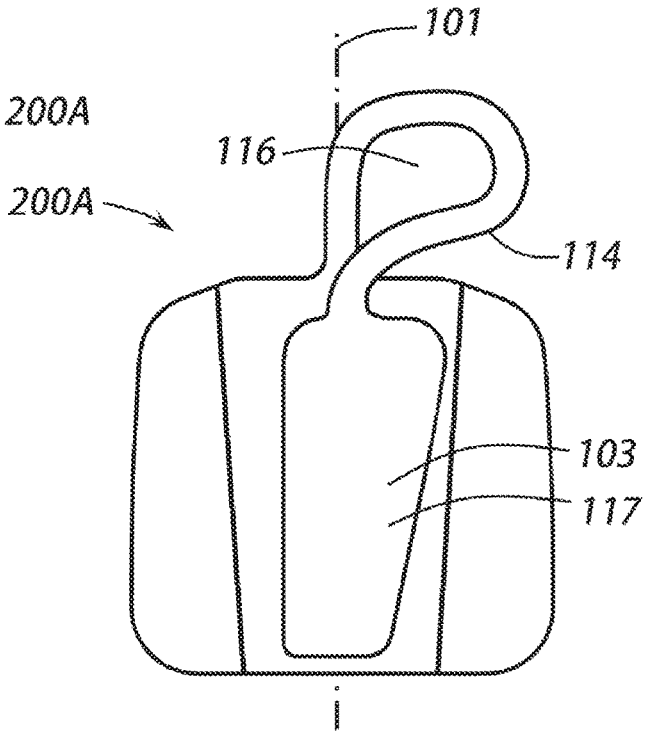

FIG. 35 to FIG. 42 show keyhead housings 200A with clamping members of different shapes and of different lengths from a truncated length to being substantially co-extensive with a base member 102 as long as the keyhead housings 200A have a clamping zone sufficiently long for securely clipping a key on a clothing item. FIG. 35 shows a keyhead housing 200A with a clamping section 117 formed with a pointed clamping section uppermost side surface first end 137 for additional pegging a clothing item 500. FIG. 36 shows a keyhead housing 200A with a clamping section 117 which protrudes beyond the base member lowermost side surface 111. FIG. 37 shows a keyhead housing 200A with a truncated clamping section 117. FIG. 38 to FIG. 40 show keyhead housings 200A with strip-like clamping sections 117 compared to the FIG. 10 clamping section 117. FIG. 38 shows a straight strip-like clamping section 117. FIG. 39 shows a strip-like clamping section 117 with a transverse extension. FIG. 40 shows a strip-like clamping section 117 with an L-shaped extension to assume an overall hook appearance. FIG. 41 and FIG. 42 show clamping members 103 with bridge sections 114 which are employed for forming a throughgoing retaining aperture 116 having a closed shape in the keyhead housing 200A's front elevation view facing the clamping section 117. FIG. 42 shows a throughgoing retaining aperture 116 asymmetrical with respect to the longitudinal spring clip centerline 101.

Figure 43:
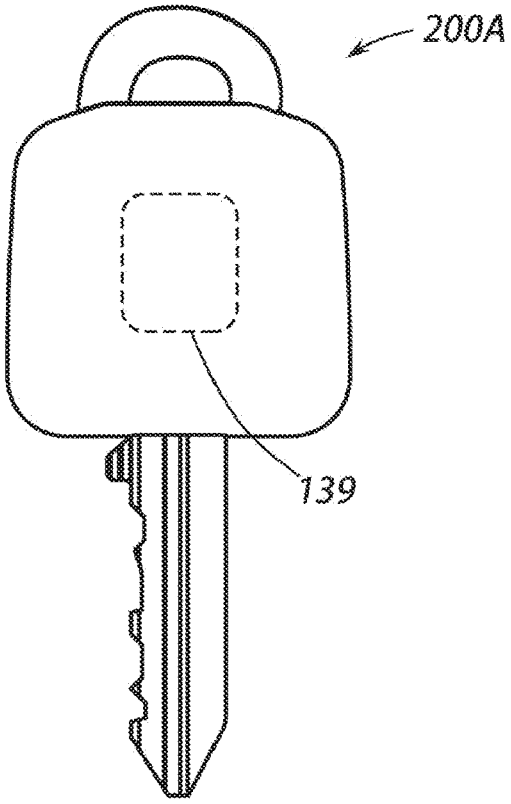
FIG. 43 is a front elevation view of a keyhead housing with an electronic chip.

FIG. 43 shows a keyhead housing 200A with an electronic chip 139. The electronic chip 138 can be a GPS chip, an Europay Mastercard Visa (EMV) chip, an access entry chip, and the like. Exemplary access entry chips are now available for providing access to a secure facility, for example, an office block, a residence building, and the like. The electronic chip 139 can either require reader contact or be contactless.

Figure 44:
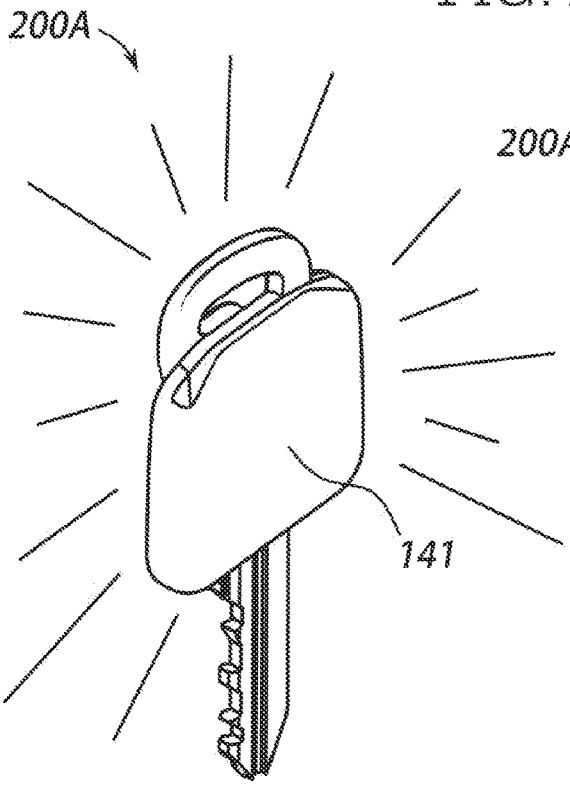
FIG. 44 is a front perspective elevation view of a keyhead housing made from luminescent material.

FIG. 44 shows a keyhead housing 200A having at least one luminescent or reflective surface 141 for assisting a user to be noticed in the dark.

Figure 45:
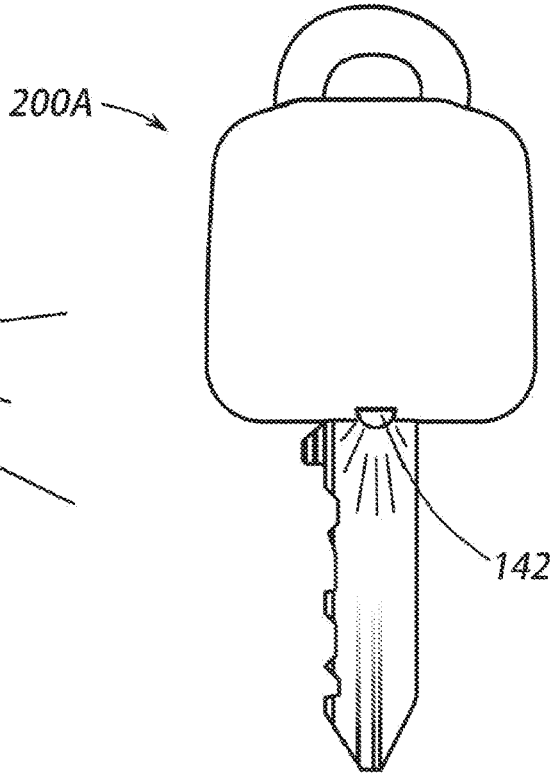
FIG. 45 is a front elevation view of a keyhead housing with a LED.

FIG. 45 shows a keyhead housing 200A with a LED 142.

While particular embodiments of the present invention are illustrated and described, it would be obvious to those skilled in the art that various other changes and modifications can be made without departing from the spirit and scope of the invention.

The invention claimed is:

1. A key assist device for being interchangeably either attached to a split ring of a key ring and detached therefrom or clipped on a clothing item and removed therefrom, the split ring bounding a split ring aperture having a split ring aperture plane, the clothing item having a clothing item hem, the key assist device for use or integral with a key having a longitudinal key centerline and including a generally planar keyhead and a keyshank, the keyhead having a keyhead plane, a keyhead front surface, a keyhead back surface, and a keyhead peripheral surface, the keyhead peripheral surface having a trailing keyhead peripheral surface and a leading keyhead peripheral surface with the keyshank extending therefrom along the longitudinal key centerline, the key assist device comprising a spring clip having a longitudinal spring clip centerline and including:

a) an elongated planar base member having a base member front surface, a base member back surface, a pair of opposite spaced apart base member side surfaces co-directional with said longitudinal spring clip centerline, and a pair of opposite spaced apart base member side surfaces transverse to said longitudinal spring clip centerline, said pair of opposite spaced apart base member side surfaces transverse to said longitudinal spring clip centerline including a base member uppermost side surface and a base member lowermost side surface; and b) a clamping member resiliently flexibly connected to said base member uppermost end surface and including:

i) a clamping section overlying said base member front surface to bound a clamping zone therebetween, said clamping section being viewable in a front elevation view of the spring clip thereby concealing said clamping zone therebehind, ii) a bridge section resiliently flexibly extending between said elongated planar base member and said clamping section, said bridge section having a bridge section first end and an opposite bridge section second end, said bridge section first end connected to said base member uppermost side surface and said bridge section second end connected to said clamping section, wherein said bridge section bounds a throughgoing retaining aperture spaced apart from said clamping zone, said throughgoing retaining aperture having a closed shape in said front elevation view of the spring clip, the key assist device, in use, being either i) freely suspended from the split ring on sliding insertion of the split ring between said base member and said clamping section into said throughgoing retaining aperture whereupon the keyhead plane traverses the split ring aperture plane, or ii) clamped on the clothing item on sliding insertion of the clothing item hem between said base member and said clamping section through said clamping zone towards said bridge section.

2. The key assist device according to claim 1 and further comprising a keyhead housing for use with a discrete key, said keyhead housing having a longitudinal keyhead housing centerline and integrally formed with said spring clip, said keyhead housing including a keyhead housing front surface, a keyhead housing back surface, opposite keyhead housing side surfaces co-directional with said longitudinal keyhead housing centerline, and a keyhead housing uppermost side surface transverse to said longitudinal keyhead housing centerline and an opposite keyhead housing lowermost side surface transverse to said longitudinal keyhead housing centerline, said throughgoing retaining aperture being said spaced apart from said keyhead housing uppermost side surface, said keyhead housing defining a keyhead housing cavity between said keyhead housing front surface and said keyhead housing back surface shaped and dimensioned for snugly entrapping the keyhead, said keyhead housing having at least one slot for enabling sliding insertion of the keyhead into said keyhead housing cavity such that the keyshank extends from said keyhead housing co-directional with the longitudinal keyhead housing centerline.

3. The key assist device according to claim 2 wherein said keyhead housing includes an internal spacer for reducing the dimension of said keyhead housing cavity between said keyhead housing front surface and said keyhead housing back surface for use with a discrete thin key.

4. The key assist device according to claim 2 wherein said keyhead housing front surface is arched toward said keyhead housing back surface for reducing the dimension of said keyhead housing cavity between said keyhead housing front surface and said keyhead housing back surface for use with a discrete thin key.

5. The key assist device according to claim 2 wherein said keyhead housing includes a keyhead housing major slot in said keyhead housing uppermost side surface and a keyhead housing minor slot in said keyhead housing lowermost side surface and said bridge section is shaped to overlie said keyhead housing major slot to prevent a keyhead from sliding back out through said keyhead housing major slot.

6. The key assist device according to claim 2 wherein said keyhead housing further comprises a pocket for receiving a coin.

7. The key assist device according to claim 1 and further comprising a keyhead connector for fastening onto a discrete key's keyhead, the keyhead having a throughgoing bore for attaching the discrete key onto the split ring, said keyhead connector including a keyhead connector support with a transverse directed pin for insertion through the key's throughgoing bore, and a keyhead connector closure for mounting on said pin for securing the key on said keyhead connector, said keyhead connector support being integrally formed with said spring clip and said throughgoing retaining aperture being said spaced apart from said keyhead connector support.

8. The key assist device according to claim 1 constituted by a clip-on-key having a keyhead integral with said spring clip and a keyshank wherein said throughgoing retaining aperture is said spaced apart from said keyhead.

9. The key assist device according to claim 1 wherein said base member front surface includes a spaced apart pair of retaining projections on either side of said clamping section for retaining said clamping section therebetween.

10. The key assist device according to claim 1 and further comprising an electronic chip wherein said electronic chip is one of a GPS chip, an EMV chip, and an access entry chip.

* * * * *